US012042738B2

(12) United States Patent
Simmons

(10) Patent No.: US 12,042,738 B2
(45) Date of Patent: Jul. 23, 2024

(54) CHESS M.D. (MULTI-DIMENSIONAL)

(71) Applicant: Mark Jason Simmons, Bronx, NY (US)

(72) Inventor: Mark Jason Simmons, Bronx, NY (US)

( * ) Notice: Subject to any disclaimer, the term of this patent is extended or adjusted under 35 U.S.C. 154(b) by 0 days.

(21) Appl. No.: 16/974,133

(22) Filed: Oct. 15, 2020

(65) Prior Publication Data

US 2021/0077897 A1 Mar. 18, 2021

Related U.S. Application Data

(63) Continuation-in-part of application No. 16/550,047, filed on Aug. 23, 2019, now abandoned.

(60) Provisional application No. 62/765,722, filed on Sep. 10, 2018.

(51) Int. Cl.
*A63F 3/00* (2006.01)
*A63F 3/02* (2006.01)

(52) U.S. Cl.
CPC ..... *A63F 3/00214* (2013.01); *A63F 3/02* (2013.01); *A63F 2003/00217* (2013.01); *A63F 2003/0022* (2013.01)

(58) Field of Classification Search
CPC ..... A63F 3/00214; A63F 3/02; A63F 2003/00217; A63F 2003/0022
See application file for complete search history.

(56) References Cited

U.S. PATENT DOCUMENTS

| | | | | |
|---|---|---|---|---|
| 4,348,027 | A * | 9/1982 | Escamilla-Kelly | A63F 3/00214 273/284 |
| 6,276,685 | B1 * | 8/2001 | Sterling | A63F 3/00214 273/249 |
| 7,219,895 | B1 * | 5/2007 | Hutchins, Jr. | A63F 3/02 273/261 |
| 2005/0285339 | A1 * | 12/2005 | Park | A63F 3/02 273/260 |
| 2007/0296149 | A1 * | 12/2007 | Hughes | A63F 3/00214 273/241 |
| 2013/0033004 | A1 * | 2/2013 | Van Ness | A63F 9/0252 273/357 |
| 2014/0070489 | A1 * | 3/2014 | Spencer | A63F 3/00533 273/241 |

* cited by examiner

*Primary Examiner* — Michael D Dennis
(74) *Attorney, Agent, or Firm* — Hanrahan Law Firm, P.A.; Benjamin M. Hanrahan

(57) ABSTRACT

A three dimensional chess game method and apparatus which features four levels, one square, non-playing surface baseboard and four square sub-levels, one quarter the size of the baseboard, adjacent and above the base board at various heights. Sub-levels are divided into sixteen squares, by combining the squares from all of the sub-levels there are sixty-four possible playing positions. The King, queen, bishop and knight acquire three dimensional movement by using the height difference between sub-levels, and using square placement on each sub-levels as equal, when the king, queen, or bishop land on a square on any sub-level, all sub-levels holds a virtual playing piece on that square location. Three dimensional movement is obtained through rotation around center point of the chess board as the piece moves from sub-level to sub-level and X, Y and Z, movements between sub-levels which is utilized by the knight.

14 Claims, 7 Drawing Sheets

CHESS M.D. (MULTI-DIMENSIONAL)

CLAIM OF PRIORITY/CROSS-REFERENCE TO RELATED APPLICATIONS

The present application is a Continuation-In-Part Patent Application of U.S. patent application Ser. No. 16/550,047 filed on Aug. 23, 2019, which is based on and claims priority under 35 U.S.C. § 119(e) to U.S. Provisional Patent Application No. 62/765,722, filed on Sep. 10, 2018.

FIELD OF THE INVENTION

This invention is in the field of toys and games, and more specifically, is directed to a three-dimensional, multi-level or multi-tiered chess game board or apparatus, and a method of playing chess on a three-dimensional, multi-level or multi-tiered chess game board.

BACKGROUND OF THE INVENTION

The traditional chess board is a square board with a single horizontal playing surface consisting of sixty-four equal sized game piece position squares. Each position square is one of two possible colors which alternate along the playing surface. The chess board design has not changed significantly over the years, and a game of chess is played thereon according to rules, which likewise are basically the same. The complexity of chess comes from the predetermined movement patterns of the individual pieces. All moves are restricted to the horizontal X, Y plane creating a variety of potential geometric patterns.

Three dimensional chess is not a new concept, for example Raumschach (German for space chess) is one of the oldest three dimensional chess variants and has survived until present times. Herr Doktor Ferdinald Maack invented Raumschach in 1907. The most familiar three dimensional chess variant is Tri Dimensional chess, which was popularized by STAR TREK® the television series. Many three dimensional chess games do not successfully extend traditional chess into three dimensions. They are still planar games with multi-levels and many different rules, and they all lack a simple way of utilizing three dimensional movements. Additionally, another problem that arises is that with multi-level games, there is a lot of territory to cover with the standard sixteen chess pieces. The added playing positions extends the playing time, making some three dimensional games monotonous and uninteresting.

Because of the increase of playing levels and pieces, multi-level playing boards are more complex than traditional chess. Three dimensional chess requires more skill and playing experience, because of their multiple levels, and increased playing positions.

The present invention solves these and many other problems associated with prior art.

SUMMARY OF THE INVENTION

At least one objective of the present invention is to make the game of chess more fun and exciting, by introducing basic chemistry, physics, and math principles to extend the play into three dimensions. The present invention provides a novel three dimensional, multi-tiered game board, that includes one square, non-transparent base board, which is not a playing surface, and four, square, transparent, sub-levels. Each sub-level is divided into sixteen playing squares of two alternating colors displayed thereon. Combining the sub-levels, a total of sixty-four playing squares are available.

The three dimensional game board is a multi-tier structure with four sub-levels that are raised above the base board through the use of sixty-four transparent rods. The rods are cut in three lengths. Sub-level one is located one half inch above the base board and consisting of sixteen rods centered at the bottom of the squares. Sub-levels two and three are both located one inch above the base board with each sub-level consisting of sixteen rods centered at the bottom of each square. Sub-level four is raised off of the base board by one and one half inches, with sixteen rods centered at the bottom of each square.

Sub-levels one through four are vertically displaced with respect to one another by one quarter of an inch, and with one corner from each sub-level being vertically aligned with one corner of the base board level. This creates an eight by eight matrix chess board, with sixty-four playing squares, when looked at from a bird's eye view. Also, looking at the board from a player's perspective, four, four by four matrix sublevel chess board are seen, with a total of sixty-four playing squares and sixteen virtual folded squares in the Z dimensional axis. A quarter inch height difference is created between the boards producing sixteen virtual folded dimensional squares, folded squares are not real and can't be landed on, they are virtual squares used by the Knights to maneuver from sub-level to sub-level.

Further, t is an object of the present invention to provide an interpretation of the electron ground state in atoms as a rule for movement on the game board by making the first row of the sub-levels equal to a zero energy row. The king, the queen, the bishop, and the knight must move off of this row in order to utilize three dimensional movement.

Another object of the present invention is to provide an interpretation of quantum superposition as a rule to move on the game board through the creation of virtual playing pieces including the king, the queen, and the bishop. Playing pieces are located on a specific location notation playing squares which are related to each sub-level. All squares between rows two and four, and columns one through four, having the same location notation number are equal, after moving to a specific square, the player can choose to move in an X and Y pattern of modem chess, or use the location notation number to move to an equivalent square on another sub-level. If an opponent's piece is located on that square it can be captured.

Another component of the objective of the present invention is to provide an interpretation of linear transformation relationship to rotating vectors in three dimensional spaces, as a rule for movement on the game board. Using the location notation number of the squares found on the sub-levels, a dimensional movement of rotation around the center point of the eight by eight matrix board and reflection by the bisection of the eight by eight board is created. This is added to the X and Y dimensional movement of the king, the queen, and the bishop. The bishop can only use the location notation number on those sub-levels that are diagonal to its movement.

Another objective of the present invention is to keep the number of playing levels low and by keeping the three dimensional movements of the playing pieces confined to the two dimensional sub level playing boards. The location notation number for the squares are found by counting from row two to four, bottom to top of a sub-level board, and by counting the columns from left to right, column one to column four of the sub-level board.

The first row is the zero energy row. If the king, queen, bishop or knight land on the first row, row they must move off of the first row in the normal X and Y dimensional pattern as founded in two dimensional chess rules. Using the location notation number of the squares on any sub-levels creates dimensional movements of rotation and reflection around and through the center of the eight by eight matrix chess board.

The foregoing, and other objectives of the present invention, including the invention itself, may be understood from the following description when read in conjunction with the accompanying drawings.

DETAILED DESCRIPTION OF THE INVENTION

Figure 1:
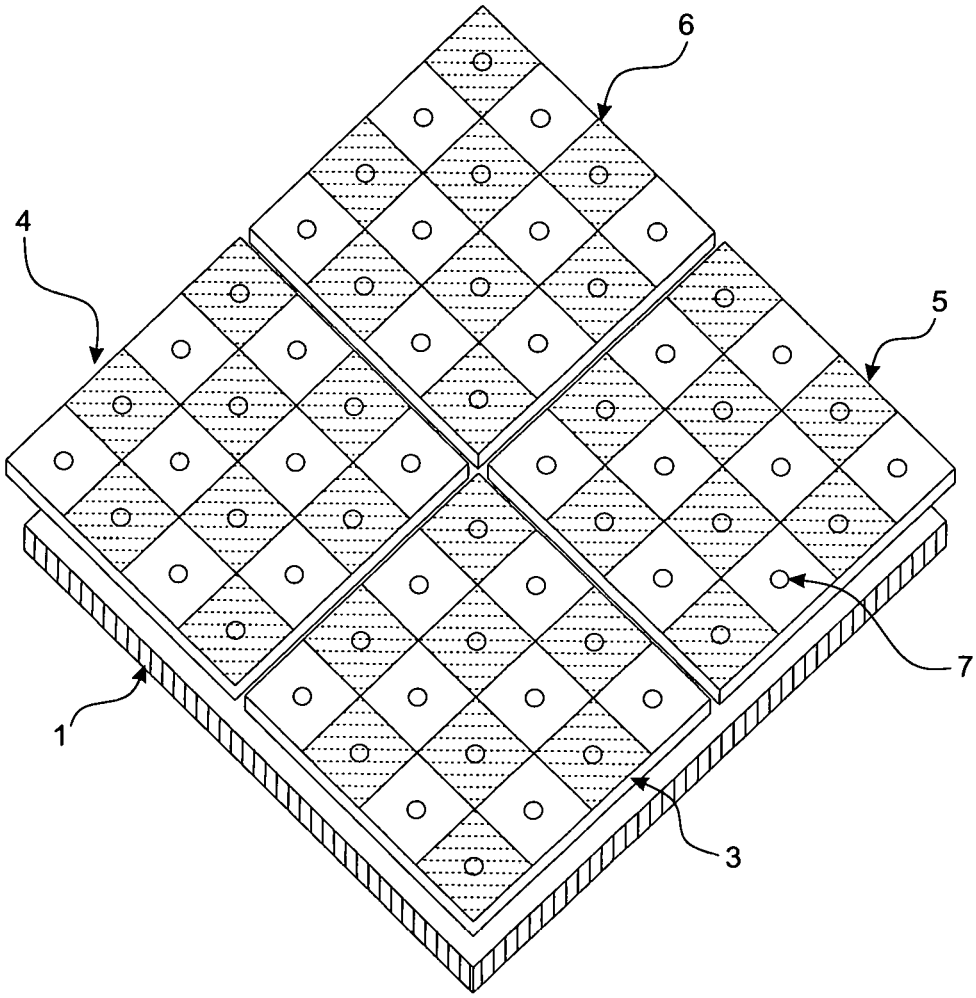
FIG. 1 is a perspective view of a chess board according to an embodiment of the present invention.

FIG. 1 is a perspective view of a three-dimensional, multi-level and/or multi-tiered game board for playing three dimensional chess. In one embodiment of the present invention the multi-level game board can be made from a single mold using a variety of substance(s), such as plastic and glass, or made without a mold from wood or other materials.

The multi-level game board of FIG. 1 includes a non-transparent, square baseboard 1, and four square, transparent sub-levels, such as a first sub-level or sub-level one 3, a second sub-level or sub-level two 4, a third sub-level or sub-level three 5, and a fourth sub-level or sub-level four 6. In this example sub-level one 3, sub-level two 4, sub-level three 5, sub-level four 6. With reference to FIG. 1, as well as the top plan view of FIG. 2, each of the sub-levels 3, 4, 5, 6, separately comprise one quarter the size of the baseboard 1 (not shown in FIG. 2), and each of the sub-levels 3, 4, 5, 6 are divided into sixteen squares.

Furthermore, collectively the sub-levels, such as sub-level one 3, sub-level two 4, sub-level three 5, and sub-level four 6, are raised above the base board 1 with sixty-four transparent rods 7. More specifically, in this example, each of the sub-levels, such as sub-level one 3, sub-level two 4, sub-level three 5, and sub-level four 6, are attached to sixteen transparent rods 7, wherein each of the transparent rods 7 are located under one of the sixteen playing squares at its center. More in particular, the first sub-level or sub-level one 3 is raised off of the base board 1 by one half of an inch, the second sub-level or sub-level two 4 and the third sub-level or sub-level three 5 are each raised above the base board 1 by one inch, and the fourth sub-level or sub-level four 6 is raised above the base board 1 by one and one half inches.

Figure 3:
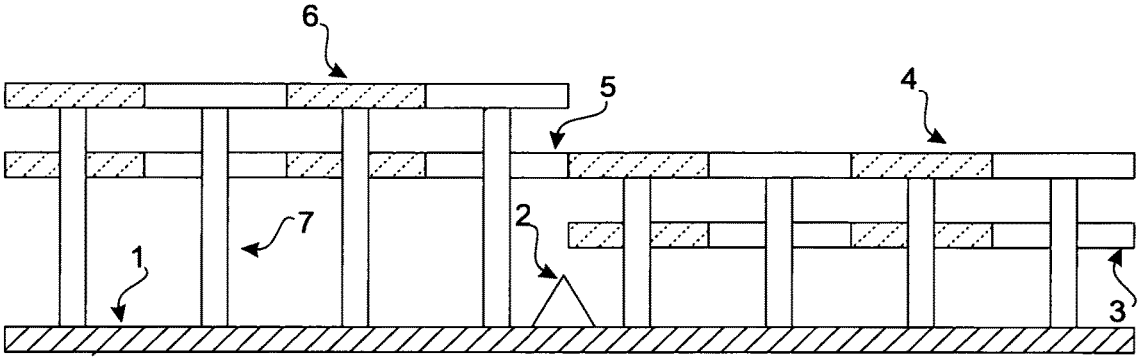
FIG. 3 is a front elevation view of a chess board according to an embodiment of the present invention.
Figure 4:
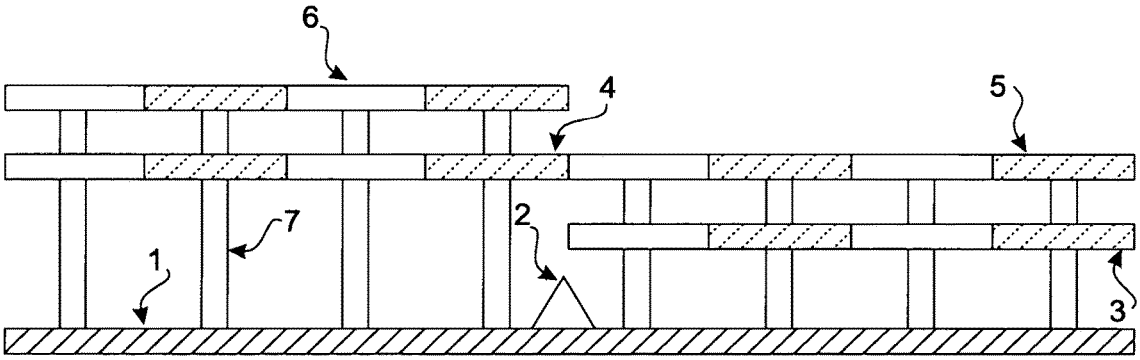
FIG. 4 is a left side elevation view of a chess board according to an embodiment of the present invention.
Figure 5:
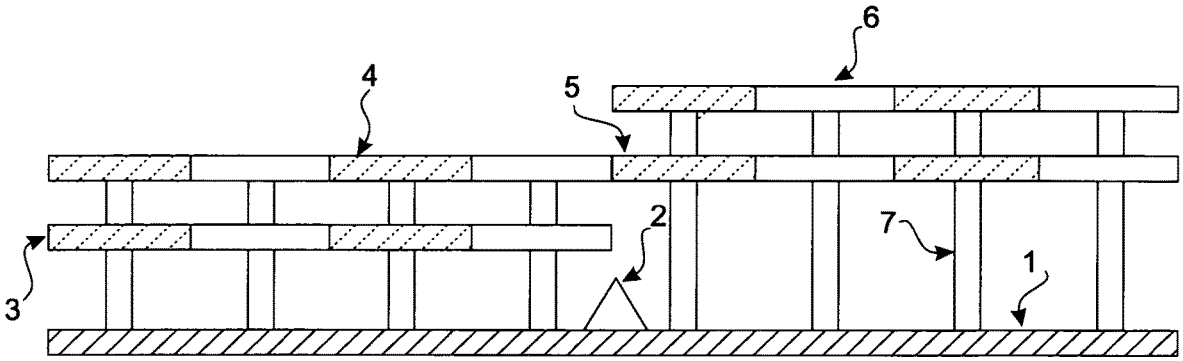
FIG. 5 is a right side elevation view of a chess board according to an embodiment of the present invention.

With reference now to FIGS. 3, 4 and 5, front, left side and right side elevation view, respectively, of the game board according to an embodiment of the present invention are shown. In particular, as shown in FIGS. 3-5, each of the sub-levels 3-6 are raised above the base board 1 via transparent rod 7. The height difference creates virtual folded squares in the Z axis dimension. The extra folded squares are not playing squares; rather, they are used by the knight to move between the sub-levels, such as, between sub-level one 3, sub-level two 4, sub-level three 5, and sublevel four 6.

Moreover, the game board has a total of sixty-four playing squares with sixteen playing squares on each of the separate sub-levels 3, 4, 5, 6. The squares on each of the sub-levels 3, 4, 5, 6 are colored so that alternating squares contrast with one another. Thirty two of the squares are clear and transparent, and the other thirty two squares are shaded with a transparent color. In this example, when light is transmitted through the sub-levels 3, 4, 5, 6, a two dimensional, eight by eight matrix chess board is reflected off of the base board 1 surface. This is a visual representation of the relationship between dimensional surfaces, like shadows on walls.

In one embodiment the base board 1, has at its center a small pyramid 2 with an apex that is aligned with the center corners of each of the four sub-levels 3, 4, 5, 6, which are vertically displaced above the pyramid. The base board 1 and the pyramid 2 is a visual representation of space-time and the point, or singularity where the two dimensional reflected chess board on the base board 1 becomes a three dimensional chess board surface.

Location Notation Number

Figure 2:
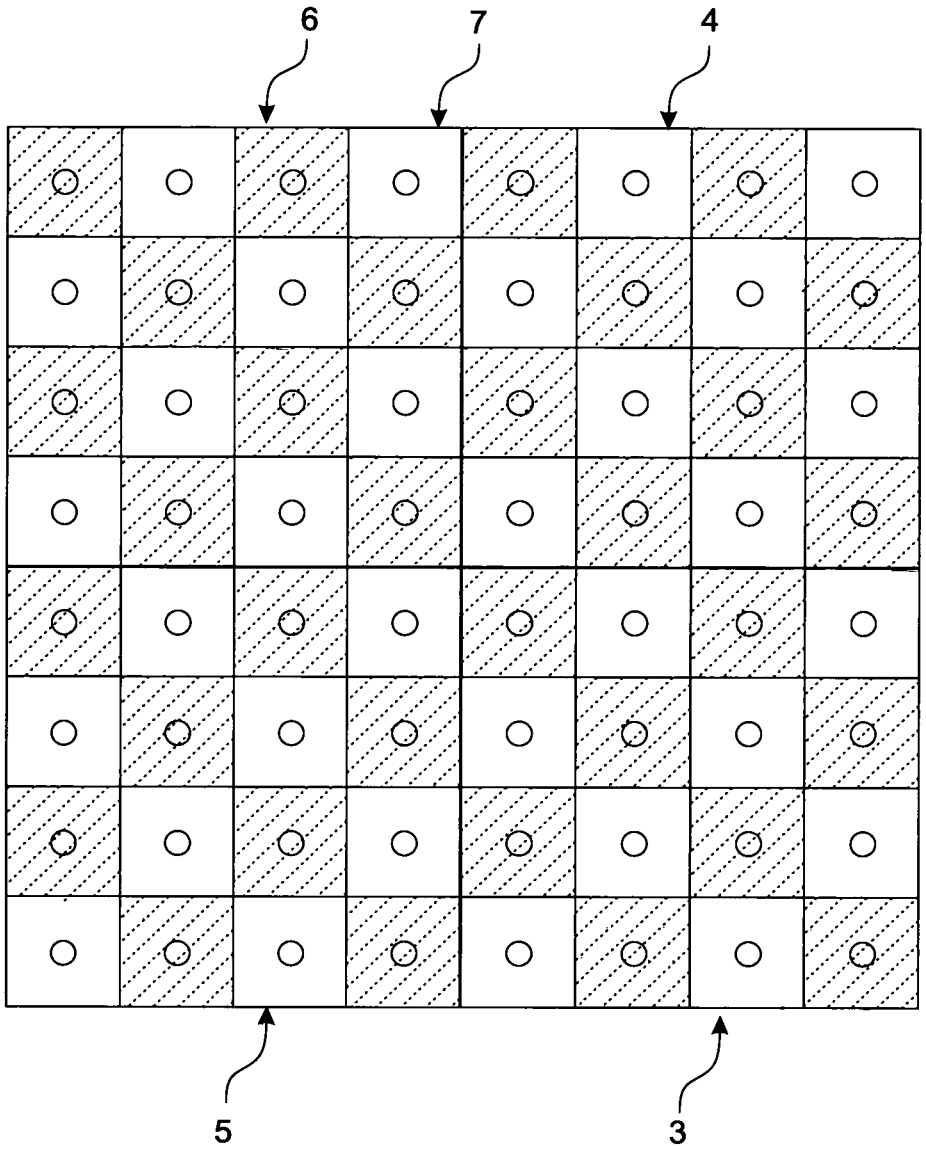
FIG. 2 is a top plan view of a chess board according to an embodiment of the present invention.

To visualize the movement of the playing pieces the game board will be shown laid out as in FIG. 2, the four, four by four sub levels sub-levels are designated numbers one through four. When combined as showed in FIG. 2 the board creates an eight by eight board with sixty-four squares which can be used as playing positions. Starting from the bottom row closest to the player, the rows are labeled one through four; counting from bottom to top of the sub-level and counting from left column to right the column of the sub-level board, columns are labeled one through four. Thus, the notation for referring to any squares on the four different sub levels, where the first digit is the number designating the sub level, the second digit represents the row number, and the Third digit represents the column number. The location notation 333 designates the square on sub-level three, row three, and column three. The location notation for the other three boards; 133,233 and 433 are all equal playing squares. Moving to any one of these squares creates a dimensional movement of rotation or reflection with respect to the center point of the eight by eight matrix playing board. The king, queen, bishop and the knight must follow specific rules in order to move around the sub-levels these rules are based in the following;

First Row—Zero Energy State

The ground state electron configuration is the arrangement of electrons around the nucleus of an atom within lower energy levels; electrons occupying the orbitals of varying energy levels naturally fall towards the lowest energy state or ground state. Row one with respect to the players, is considered the ground state or zero energy state for the king, queen, bishop and knight. In order to use the three dimensional moves the playing piece must move off of row one.

Virtual Particles; King, Queen and Bishop

In quantum theory quantum particles can exist in a superposition of states at the same time and collapse down to one single state upon interaction with other particles. In physics a virtual particles is a transient quantum fluctuation that exhibits some of the characteristics of the ordinary particle, while having its' existence limited by the uncertainty principle. When the king, queen, or bishop moves off of row one, the square's location notation number that they are resting on is related to the squares on all sub-level boards that share the same location notation number. The pieces are in a quantum superposition state, thus the squares sharing the same location notation number holds a virtual particle of the pieces. Upon the player's next move after landing on a square, they have a choice to either move in a X and Y dimensional axis as found in modem chess rules, or use the location notation number to move to that square on another sublevel that shares the same location notation number, if an opponent's piece is located on that square it can be capture. This rule does not apply to the first row.

Pieces can be moved around the boards from different points of view, the first, where the boards are an eight by eight grid matrix playing board with movement in the X and Y dimensional axis following basic chess rules, and second; as a three dimensional playing board comprising four sub-level boards each having a four by four grid matrix playing board setup with location notation numbers attached to each square. Using the location notation number between sub-levels creates virtual playing pieces on all boards. Three dimensional movement is created in the form of rotation and reflection with respect to the sublevels. Each sub-level board is located at a slightly different height with respect to one another this height difference creates sixteen virtual squares that is used to create X, Y and Z dimensional axis movement for the knight to maneuver between sub-levels.

The King

Figure 6:
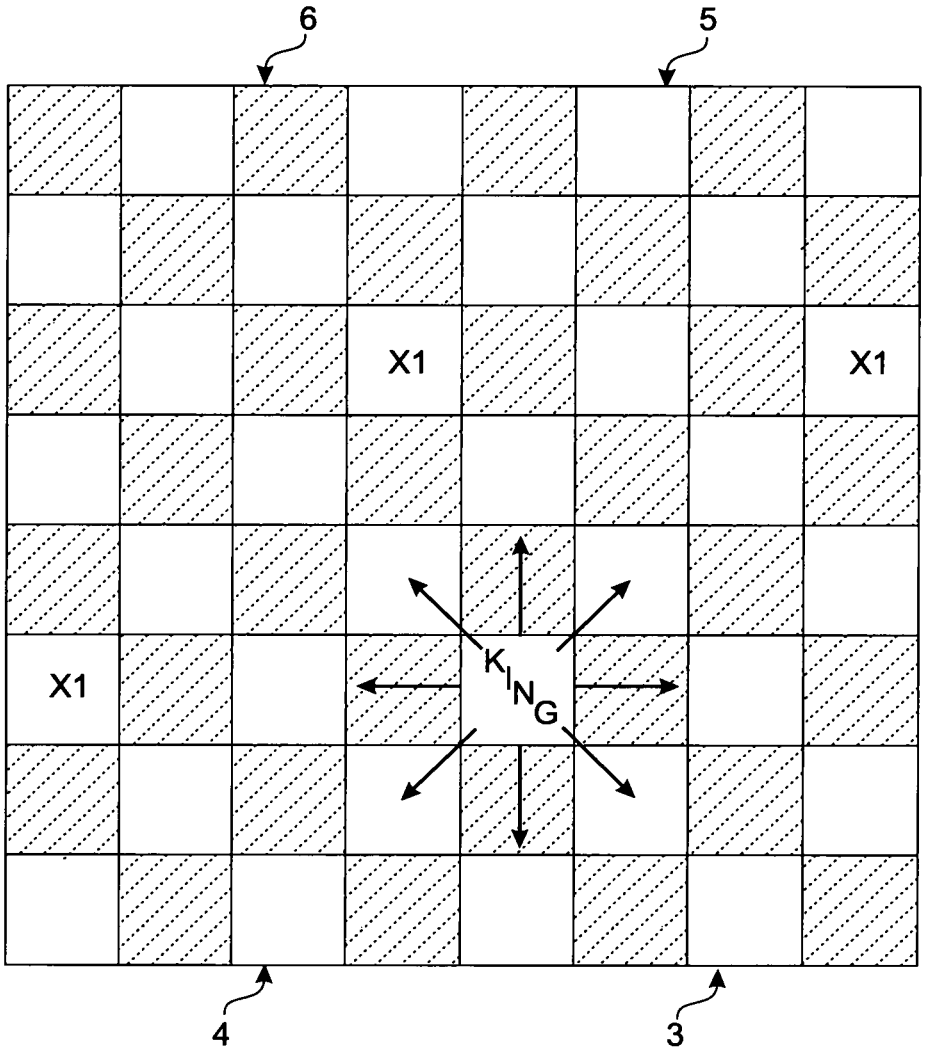
FIG. 6 shows the movement of the king according to an embodiment of the present invention.

FIG. 6 shows the movement of the king according to an embodiment of the present invention. As shown in FIG. 6, the king must first move off of row one in order to use the sub-levels as individual boards. The king can move in the normal two dimensional manner found in modem chess (e.g., as represented by the eight arrows extending from the "KING" text in FIG. 6), or the king can use the squares (e.g., as represented by X1 in FIG. 6) on the sub-levels that share a similar location notation as playing positions. In this embodiment a virtual King is created on all of the sub-level playing boards upon the King's next move, after landing on a designated square, the king can move to another sub-level square having the same location notation number (e.g., the squares labelled as X1 in FIG. 6). This gives the king three extra squares to defend or attack. If the square is occupied by an enemy's piece, then that piece can be captured. This move creates a three dimensional movement in terms of rotation around the center point of the eight by eight matrix playing board and reflection, through the bisected eight by eight playing board.

The Queen

Figure 7:
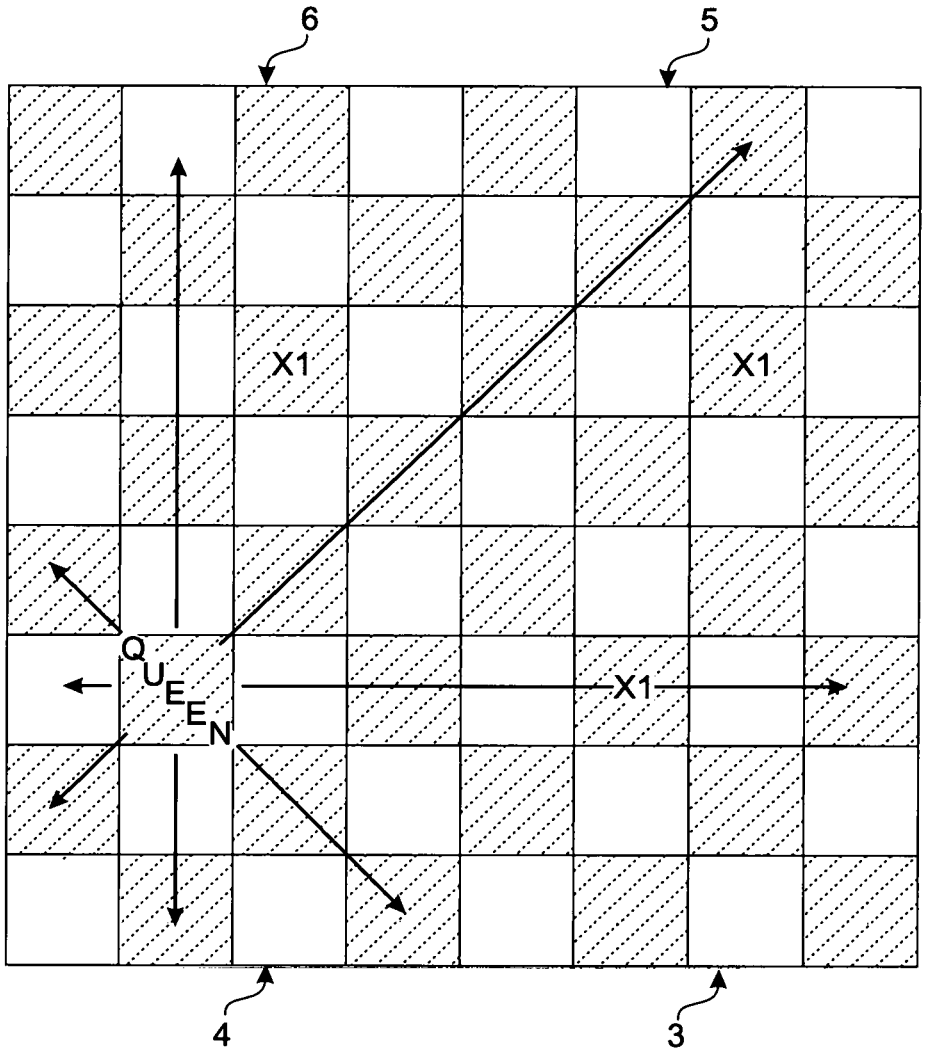
FIG. 7 shows the movement of the queen according to an embodiment of the present invention.

FIG. 7 shows the movement of the queen and according to an embodiment of the present invention. In this example, the queen must first move off of the first row, zero ground state, in order to utilize the three dimensional moves on all sub-level boards. The queen can move in the normal two dimensional ways found in classic chess (e.g., as represented by the eight arrows extending from the "QUEEN" text in FIG. 7), or, as represented by X1 in FIG. 7, the queen can use the square's location notation number to move around the sub-levels. In this embodiment a virtual queen is created on all the sub-level playing boards after landing on designated squares, the queen can move to another sub-level square having the same location notation number (e.g., as represented by X1 in FIG. 7). This gives the queen three extra squares to defend or attack. If an enemy's piece is occupying that square then the queen can capture that piece. This move creates a three dimensional movement in terms of rotation around the center point of the eight by eight matrix playing board and reflection through the bisected eight by eight matrix playing board.

The Knight

Figure 8:
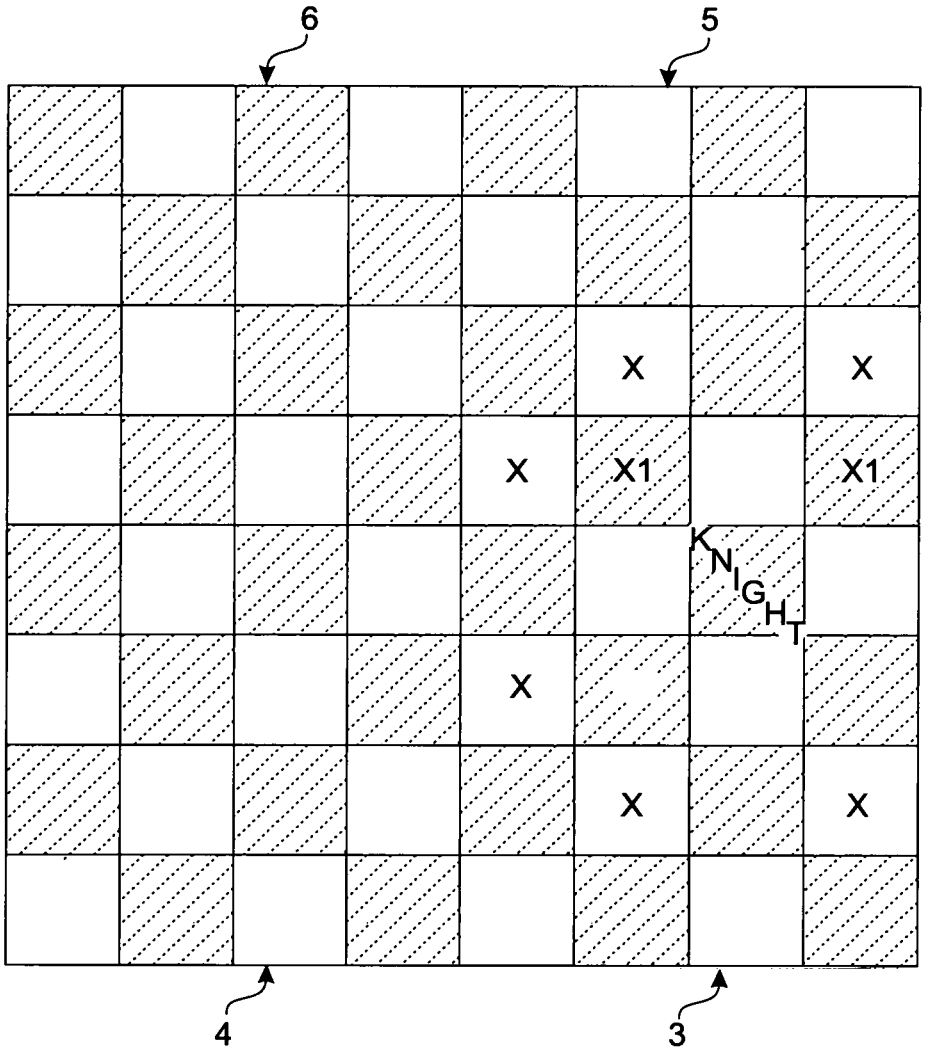
FIG. 8 shows the movement of the knight according to an embodiment of the present invention.

FIG. 8 shows the movement of the knight according to an embodiment of the present invention. In this example the height difference of the sub-levels 3, 4, 5, 6, provides virtual folded squares (e.g., as represented by X1 in FIG. 8) to be utilized by the knight. In this embodiment, when the knight is located along the borders between sub-levels such as on row four, column one through four on all sub-levels one through four, along the border the knight can follow basic modem chess rules (e.g., as represented by the letter "X" in FIG. 8), or use the imaginary square (e.g., as represented by "X1" in FIG. 8) to maneuver from sub-level to sublevel. This also applies when the knight is located on squares that are located on sub-levels two 4, and sub-level three 5, column four, rows two through four, or located on sub-level one 3, and sub-level four 6, column one, rows two through four. The virtual squares create up to three extra playing squares to defend or capture an enemy's piece.

The Bishop

Figure 9:
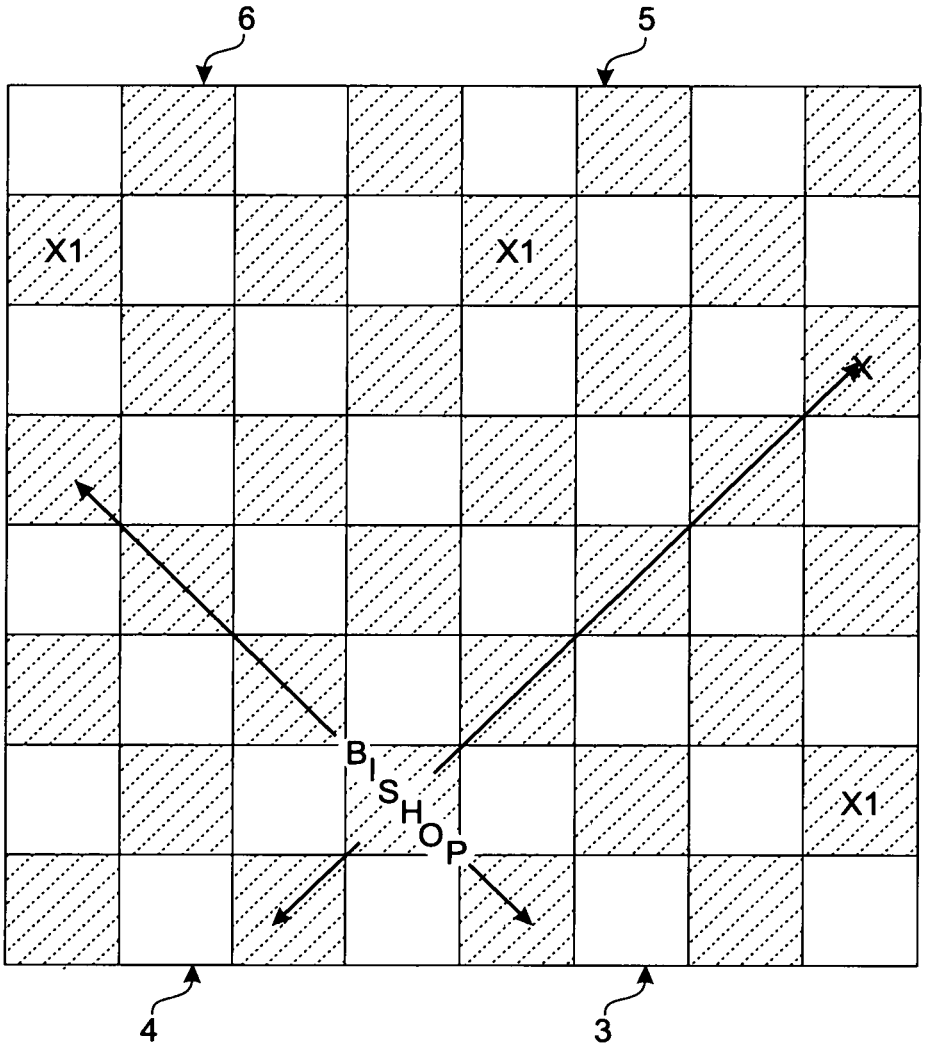
FIG. 9 shows the movement of the bishop according to an embodiment of the present invention.

FIG. 9 shows the movement of the bishop according to an embodiment of the present invention. In this example, the bishop must first move off of row one in order to utilize the three dimensional moves. The bishop can move diagonally across the board as found in classic chess (e.g., as represented by the four arrows extending from the "BISHOP" text in FIG. 9), or, by using the location notation number the bishop can move diagonally across the sub-levels that are diagonally situated (e.g., as represented by "X1" in FIG. 9). In this embodiment not all sub-level board location notations numbers are available to the bishop, only the boards that are diagonal to its movement will be allowed. Using the location notation number creates up to three extra playing squares (e.g., as represented by "X1" in FIG. 8) for the Bishop to defend or attack. If an enemy's piece is on the square that the bishop wants to move to, it can capture the piece. This move creates a three dimensional movement in terms of rotation around the center point of the eight by eight matrix playing board and reflection through the bisected eight by eight matrix playing board.

Possible Variation of the Game Board

Having described what I currently believe to be the best mode of carrying out my invention, I shall now describe possible variations to the game board, which is presented as an alternate embodiment of the invention. One possible variation of the game board is to place two different color LEDS into the base level, directly under each of the rods supporting the sub levels. The two different colors will be assigned to the two different color game pieces, such that when a piece is picked up off of the board to move, one of the two color LEDS will light up all of the potential playing positions squares. The LEDS will be controlled by a small micro-processor, light sensors and a power source, such as a battery. Players now have the option to play against an opponent or against the computer. Another alternative to the game is to place multiple LEDS into the pyramid found on the base board. The LEDS will light up whenever a player is check mated. Another alternative is to substitute the pyramid shape in the center of the baseboard to any geometric shape.

I claim:

1. A method for playing multi-dimensional chess, the method comprising:

providing a tabletop chess board comprising a non-playing baseboard and four sub-level boards, defining each of said four sub-level boards as comprising a top, playing surface defining a four-by-four matrix of sixteen squares, wherein said four sub-level boards are arranged such that said top, playing surfaces are disposed in a non-overlapping relation relative to one another, defining said four sub-level boards as comprising a first sub-level board vertically spaced a first distance above said baseboard, a second sub-level board vertically spaced a second distance above said baseboard, a third sub-level board vertically spaced a third distance above said baseboard, and a fourth sub-level board vertically spaced a fourth distance above said baseboard, said second distance being equal to said third distance, said first distance being less than said second distance and said third distance, and said fourth distance being greater than said second distance and said third distance, defining said tabletop chess board as further comprising a plurality of rods mounted between said baseboard and said four sub-level boards in order to vertically space said four sub-level boards from said baseboard, said plurality of rods comprising a first set of sixteen rods mounted between said first sub-level board and said baseboard, a second set of sixteen rods mounted between said second sub-level board and said baseboard, a third set of sixteen rods mounted between said third sub-level board and said baseboard, and a fourth set of sixteen rods mounted between said fourth sub-level board and said baseboard.

2. The method as recited in claim 1 further comprising defining said baseboard as comprising four corners, and defining each of said four sub-level boards as comprising four corners, wherein one corner of each of said four sub-level boards is vertically aligned with a different one of said four corners of said baseboard.

3. The method as recited in claim 1 further comprising providing two sets of chess playing pieces, each of said sets of chess playing pieces comprising at least one pawn, at least one rook, at least one knight, at least one bishop, at least one queen and at least one king.

4. The method as recited in claim 3 further comprising:

moving at least one of the kings about the table top chess board, from a starting square, and according to predefined rules, said starting square defined as being one of said squares defined on said top, playing surface of one of said four sub-level boards, defining the predefined rules as comprising, for each move of the king, allowing the king to either: (a) be moved to an adjacent or diagonally-oriented square from said starting square, or (b) be moved to a different square on a different one of said four sub-level boards using a location notation, wherein said different square on said different one of said four sub-level boards comprises a location notation that corresponds to a location notation of said starting square.

5. The method as recited in claim 4 further comprising defining the predefined rules as comprising only allowing the king to be moved to said different square on said different one of said four sub-level boards if said starting square is not in a first row of squares in said one of said four sub-level boards.

6. The method as recited in claim 3 further comprising:

moving at least one of the queens about the table top chess board, from a starting square, and according to predefined rules, said starting square defined as being one of said squares defined on said top, playing surface of one of said four sub-level boards, defining the predefined rules as comprising, for each move of the queen, allowing the queen to either: (a) be moved to a square located to the left, right, forward, backward or diagonally from said starting square, or (b) be moved to a different square on a different one of said four sub-level boards using a location notation, wherein said different square on said different one of said four sub-level boards comprises a location notation that corresponds to a location notation of said starting square.

7. The method as recited in claim 6 further comprising defining the predefined rules as comprising only allowing the queen to be moved to said different square on said different one of said four sub-level boards using said location notation, if said starting square is not in a first row of squares in said one of said four sub-level boards.

8. The method as recited in claim 3 further comprising:

moving at least one of the bishops about the table top chess board, from a starting square, and according to predefined rules, said starting square defined as being one of said squares defined on said top, playing surface of one of said four sub-level boards, defining the predefined rules as comprising, for each move of the bishop, allowing the bishop to either: (a) be moved to a square located diagonally from said starting square, or (b) be moved to a different square on a different one of said four sub-level boards using a location notation, wherein said different square on said different one of said four sub-level boards comprises a location notation that corresponds to a location notation of said starting square.

9. The method as recited in claim 8 further comprising defining the predefined rules as comprising only allowing the bishop to be moved to said different square on said different one of said four sub-level boards using the location notation, if said starting square is not in a first row of squares in said one of said four sub-level boards.

10. The method as recited in claim 3 further comprising:

moving at least one of the knights about the table top chess board, from a starting square, and according to predefined rules, said starting square defined as being one of said squares defined on said top, playing surface of one of said four sub-level boards, defining the predefined rules as comprising, for each move of the knight, allowing the knight to either: (a) be moved in an path defined as comprising one square in one direction from said starting square, then two squares in a different direction, or two squares in one direction from said starting square, then one square in a different direction, or (b) be moved in a virtual path to a different square on a different one of said four sub-level boards using a virtual folded square, wherein the virtual path counts the virtual folded square along the path when moving the knight.

11. The method as recited in claim 10 wherein the virtual folded square is defined as being a virtual space disposed between two of said four sub-level boards.

12. A method for playing multi-dimensional chess, the method comprising:

providing a tabletop chess board comprising a non-playing baseboard and four sub-level boards, each of said four sub-level boards being vertically spaced above said baseboard, defining said baseboard as comprising four corners, and defining each of said four sub-level boards as comprising four corners, wherein one corner of each of said four sub-level boards is vertically aligned with a different one of said four corners of said baseboard, defining each of said four sub-level boards as comprising a top, playing surface defining a four-by-four matrix of sixteen squares, wherein said four sub-level boards are arranged such that said top, playing surfaces are disposed in a non-overlapping relation relative to one another, defining said tabletop chess board as further comprising a plurality of rods mounted between said baseboard and said four sub-level boards in order to vertically space said four sub-level boards from said baseboard, providing two sets of chess playing pieces, each of said sets of chess playing pieces comprising at least one pawn, at least one rook, at least one knight, at least one bishop, at least one queen and at least one king, moving at least one of the kings about the table top chess board, from a starting square, and according to predefined rules, said starting square defined as being one of said squares defined on said top, playing surface of one of said four sub-level boards, defining the predefined rules as comprising, for each move of the king, allowing the king to either: (a) be moved to an adjacent or diagonally-oriented square from said starting square, or (b) be moved to a different square on a different one of said four sub-level boards using a location notation, wherein said different square on said different one of said four sub-level boards comprises a location notation that corresponds to a location notation of said starting square, and defining the predefined rules as comprising only allowing the king to be moved to said different square on said different one of said four sub-level boards if said starting square is not in a first row of squares in said one of said four sub-level boards.

13. A method for playing multi-dimensional chess, the method comprising:

providing a tabletop chess board comprising a non-playing baseboard and four sub-level boards, each of said four sub-level boards being vertically spaced above said baseboard, defining said baseboard as comprising four corners, and defining each of said four sub-level boards as comprising four corners, wherein one corner of each of said four sub-level boards is vertically aligned with a different one of said four corners of said baseboard, defining each of said four sub-level boards as comprising a top, playing surface defining a four-by-four matrix of sixteen squares, wherein said four sub-level boards are arranged such that said top, playing surfaces are disposed in a non-overlapping relation relative to one another, defining said tabletop chess board as further comprising a plurality of rods mounted between said baseboard and said four sub-level boards in order to vertically space said four sub-level boards from said baseboard, providing two sets of chess playing pieces, each of said sets of chess playing pieces comprising at least one pawn, at least one rook, at least one knight, at least one bishop, at least one queen and at least one king, moving at least one of the queens about the table top chess board, from a starting square, and according to predefined rules, said starting square defined as being one of said squares defined on said top, playing surface of one of said four sub-level boards, defining the predefined rules as comprising, for each move of the queen, allowing the queen to either: (a) be moved to a square located to the left, right, forward, backward or diagonally from said starting square, or (b) be moved to a different square on a different one of said four sub-level boards using a location notation, wherein said different square on said different one of said four sub-level boards comprises a location notation that corresponds to a location notation of said starting square, and defining the predefined rules as comprising only allowing the queen to be moved to said different square on said different one of said four sub-level boards using said location notation, if said starting square is not in a first row of squares in said one of said four sub-level boards.

14. A method for playing multi-dimensional chess, the method comprising:

providing a tabletop chess board comprising a non-playing baseboard and four sub-level boards, each of said four sub-level boards being vertically spaced above said baseboard, defining said baseboard as comprising four corners, and defining each of said four sub-level boards as comprising four corners, wherein one corner of each of said four sub-level boards is vertically aligned with a different one of said four corners of said baseboard, defining each of said four sub-level boards as comprising a top, playing surface defining a four-by-four matrix of sixteen squares, wherein said four sub-level boards are arranged such that said top, playing surfaces are disposed in a non-overlapping relation relative to one another, defining said tabletop chess board as further comprising a plurality of rods mounted between said baseboard and said four sub-level boards in order to vertically space said four sub-level boards from said baseboard, providing two sets of chess playing pieces, each of said sets of chess playing pieces comprising at least one pawn, at least one rook, at least one knight, at least one bishop, at least one queen and at least one king, moving at least one of the bishops about the table top chess board, from a starting square, and according to predefined rules, said starting square defined as being one of said squares defined on said top, playing surface of one of said four sub-level boards, defining the predefined rules as comprising, for each move of the bishop, allowing the bishop to either: (a) be moved to a square located diagonally from said starting square, or (b) be moved to a different square on a different one of said four sub-level boards using a location notation, wherein said different square on said different one of said four sub-level boards comprises a location notation that corresponds to a location notation of said starting square, and defining the predefined rules as comprising only allowing the bishop to be moved to said different square on said different one of said four sub-level boards using the location notation, if said starting squares is not in a first row of square in said one of said four sub-level boards.

* * * * *